US008900332B2

(12) United States Patent
Lee

(10) Patent No.: US 8,900,332 B2
(45) Date of Patent: Dec. 2, 2014

(54) FUEL ADDITIVE FOR HEAVY OIL, AND FUEL OIL COMPRISING SAME

(75) Inventor: Young Seo Lee, Paju-si (KR)

(73) Assignees: Young Seo Lee, Paju-si, Gyeonggi-do (KR); Myeong Jin Lee, Gunpo-si, Gyeonggi-do (KR)

( * ) Notice: Subject to any disclaimer, the term of this patent is extended or adjusted under 35 U.S.C. 154(b) by 0 days.

(21) Appl. No.: 14/002,361

(22) PCT Filed: Mar. 2, 2012

(86) PCT No.: PCT/KR2012/001578
§ 371 (c)(1), (2), (4) Date: Aug. 30, 2013

(87) PCT Pub. No.: WO2012/121516
PCT Pub. Date: Sep. 13, 2012

(65) Prior Publication Data

US 2014/0000156 A1 Jan. 2, 2014

(30) Foreign Application Priority Data

Mar. 8, 2011 (KR) ..... 10-2011-0020362

(51) Int. Cl.

| | |
|---|---|
| ***C10L 1/10*** | (2006.01) |
| ***C10L 1/12*** | (2006.01) |
| ***C10L 1/18*** | (2006.01) |
| ***C10L 1/19*** | (2006.01) |
| ***C10L 1/24*** | (2006.01) |
| ***C10L 1/14*** | (2006.01) |
| *C10L 1/16* | (2006.01) |
| *C10L 1/182* | (2006.01) |

(52) U.S. Cl.
CPC ..... *C10L 1/2431* (2013.01); *C10L 1/14* (2013.01); *C10L 1/1616* (2013.01); *C10L 1/182* (2013.01); *C10L 2200/0438* (2013.01); *C10L 2270/026* (2013.01); *C10L 2300/20* (2013.01)
USPC ..... 44/373; 44/385; 44/374

(58) Field of Classification Search
CPC ..... C10L 10/00
See application file for complete search history.

(56) References Cited

U.S. PATENT DOCUMENTS

| | | | | |
|---|---|---|---|---|
| 6,811,721 | B1 | 11/2004 | Taylor et al. | |
| 2002/0189158 | A1 | 12/2002 | Jones et al. | |
| 2005/0139174 | A1 * | 6/2005 | Cleveland et al. | 123/1 A |
| 2010/0151396 | A1 | 6/2010 | Papachristos et al. | |

FOREIGN PATENT DOCUMENTS

| | | | | |
|---|---|---|---|---|
| KR | 20010054340 | A | * | 7/2001 |
| KR | 10-0339859 | B1 | | 6/2002 |
| KR | 10-2005-0021024 | A | | 3/2005 |
| KR | 10-2009-0105925 | A | | 10/2009 |

OTHER PUBLICATIONS

KR 20010054340A Machine Translation (reference date is Jul. 2001).*

* cited by examiner

*Primary Examiner* — Pamela H Weiss
(74) *Attorney, Agent, or Firm* — Revolution IP, PLLC

(57) ABSTRACT

Provided in a fuel additive for heavy oil, made using a composition comprising: an oil-soluble metallic compound containing any one metal selected from calcium, barium, manganese, and iron; alcohol; hydrotreated light distillate; paraffin (kerosene); mineral oil; and a nonionic surfactant. The fuel additive for heavy oil, when added in a small amount to a heavy oil, can lower the kinematic viscosity and the flash point of the heavy oil, minimize the occurrence of a residual carbon fraction, dust, a sulfur fraction, or the like, increase the caloric value of the heavy oil, and improve the combustion efficiency during the combustion of the heavy oil.

8 Claims, No Drawings

FUEL ADDITIVE FOR HEAVY OIL, AND FUEL OIL COMPRISING SAME

CROSS REFERENCE TO PRIOR APPLICATIONS

This application is a National Stage Application of PCT International Patent Application No. PCT/KR2012/001578 filed on Mar. 2, 2012, under 35 U.S.C. §371, which claims priority to Korean Patent Application No. 10-2011-0020362 filed on Mar. 8, 2011, which are all hereby incorporated by reference in their entirety.

TECHNICAL FIELD

The present invention relates to a fuel additive for heavy oil, and a fuel oil and, more particularly to, a fuel additive for heavy oil and a fuel oil comprising the same, which fuel additive is added to a heavy oil to promote combustion of the heavy oil and suppress the production of dust and residual carbon fraction.

BACKGROUND ART

Heavy oil refers to oil that contains residual oil left over from distillation of crude oil into liquefied petroleum gas (LPG), gasoline, kerosene, diesel fuel, or the like, primarily petroleum oil used to fuel diesel engines, boilers, or thermoelectric power plants. Depending on its specific gravity or viscosity, heavy oil is classified into three types: heavy oil A, heavy oil B, and heavy oil C. Among these, heavy oil C is oil with high viscosity, also referred to as bunker fuel oil C and used to fuel a large-sized combustion apparatus equipped with preheat-and-warm facility in large-sized boilers, large, low-speed diesel engines, or the like. Further, controls are imposed on the sulfur content in the fuel oil C because of the issue of air pollution.

The reason that lots of dust is produced during combustion of heavy oil lies in that the heavy oil during its use generates sludge and contains components with poor combustibility such as asphaltene powder. During the storage and heating of heavy oil, the unsaturated bonding portion is susceptible to oxidization and denatured to form a solid-state agglomerate, and flocculation causes formation of impurities and sludge. In the case of burner spray, the heavy oil including sludge is sprayed into oil droplets with large and uneven particle diameter, and the carbon adhering to the spray nozzle and the burner tile inhibits combustibility of the heavy oil. In other words, the formation of sludge in the heavy oil causes the production of soot, dust, and polycyclic organic materials. Further, the asphaltene powder contained in the heavy oil by 1 to 7 wt. % has a high molecular weight and a low carbon combustion rate, so it generates lots of residual carbon fraction to increase the production of exhaust gas and dust.

Conventionally, there has been used a combustion accelerator such as oil-soluble organometallic compounds in order to reduce the production of dust during the combustion of heavy oil. Such a conventional method of using a combustion accelerator, however, has limitation in suppressing the generation of dust during the combustion of heavy oil. To improve the combustibility of the heavy oil and reduce the production of dust during the combustion of heavy oil, a dispersant in addition to the combustion accelerator has an important role in suppressing the formation of sludge, redispersing the produced sludge and reducing the viscosity of heavy oil to control oil droplets formed through burner spray to have a fine particle diameter. The function of an oxygen carrier is also of importance in combustion of heavy oil, because the concentration of oxygen possibly becomes reduced during the combustion of heavy oil. Accordingly, there is a demand for the development of multi-purpose fuel additives for heavy oil, including a combustion accelerator, a dispersant, an oxygen carrier, and so forth.

DISCLOSURE OF INVENTION

Technical Problem

The present invention is derived to solve the problems with the prior art. It is therefore an object of the present invention to provide a fuel additive for heavy oil that is added to heavy oil during combustion of the heavy oil to lower kinematic viscosity and the flash point of the heavy oil, thereby minimizing the production of residual carbon fraction, dust, sulfur fraction, or the like and increasing the calorific value of the heavy oil.

It is another object of the present invention to provide a fuel oil based on heavy oil.

Technical Solution

To achieve the one object of the present invention, there is provided a fuel additive for heavy oil that comprises: an oil-soluble metallic compound containing any one metal selected from calcium, barium, manganese, and iron; an alcohol; a hydrotreated light distillate; kerosene; a mineral oil; and a nonionic surfactant.

To achieve the other object of the present invention, there is provided a fuel oil based on heavy oil that includes heavy oil and the fuel additive for heavy oil.

Advantageous Effects

When added to heavy oil in a small amount, The fuel additive for heavy oil according to the present invention can lower the kinematic viscosity and the flash point of the heavy oil, minimize the production of residual carbon fraction, dust, sulfur fraction, or the like during the combustion of heavy oil, and increase the calorific value of the heavy oil to enhance the combustion efficiency. The fuel additive for heavy oil according to the present invention is used to prevent unnecessary waste of oil resources and suppress atmospheric environmental pollution and thus very useful for large-scaled boilers in the industries using heavy oil as a fuel and large, low-speed diesel engines such as marine engines.

BEST MODE FOR CARRYING OUT THE INVENTION

Hereinafter, the present invention will be described in detail. The one aspect of the present invention is directed to a fuel additive for heavy oil. The fuel additive for heavy oil comprises an oil-soluble metallic compound containing a specific metal, an alcohol, a hydrotreated light distillate, kerosene, a mineral oil, and a nonionic surfactant. The fuel additive for heavy oil according to the present invention can be classified by the constitutional components and described as follows.

Oil-Soluble Metallic Compound

The oil-soluble metallic compound, which is one of the components of the fuel additive for heavy oil according to the present invention, serves as a combustion accelerator that increases the reactivity of heavy oil to oxygen during the combustion of heavy oil to promote oxidation and accelerates the combustion reaction of the components with poor combustibility such as asphaltene powder to suppress the production of exhaust gas and dust. Preferably, the oil-soluble metallic compound in the present invention contains a metal with high combustion-accelerating reactivity and has a high solubility to oil such as heavy oil used as a fuel oil. Specific examples of the metal with high combustion-accelerating reactivity may include calcium, barium, manganese, iron, and so forth. The oil-soluble metallic compound in the present invention is preferably composed of an active metal portion and an organic ligand portion for the sake of high solubility to heavy oil used as a fuel oil. Specific examples of the oil-soluble metallic compound may include calcium acetylacetonate, calcium naphthenate, calcium oxalate, barium acetylacetonate, barium naphthenate, barium oxalate, manganese acetylacetonate, manganese naphthenate, manganese oxalate, iron acetylacetonate, iron naphthenate, iron oxalate, etc. From another view point, the oil-soluble metallic compound in the present invention may also be a metallic salt of carboxylic acid or a metallic salt of sulfonic acid.

The oil-soluble metallic compound in the present invention is most preferably an oil-soluble metallic compound containing calcium in consideration of the relative intensity of the combustion-accelerating reactivity, such as, for example, an oil-soluble metallic compound comprising at least one selected from the group consisting of calcium sulfonate, calcium acetylacetonate, calcium naphthenate, and calcium oxalate. The calcium sulfonate contains an organic functional group, such as alkyl, aryl, or alkylaryl groups. Preferably, the calcium sulfonate is calcium alkylbenzenesulfonate containing alkylaryl groups. The alkyl group of the calcium alkylbenzenesulfonate has 8 to 20 carbon atoms and acts as a dispersant or a detergent as well as a combustion accelerator. Specific examples of the calcium alkylbenzenesulfonate may include calcium dodecylbenzenesulfonate, which is a representative anionic surfactant.

In the fuel additive for heavy oil according to the present invention, the content of the oil-soluble metallic compound is preferably 25 to 55 wt. %, more preferably 30 to 50 wt. %, most preferably 35 to 45 wt. %, with respect of the total weight of the composition, in consideration of the effects of minimizing the production of dust and securing the compatibility with other components.

Even when an excess of air for combustion is supplied during the combustion of heavy oil, the burnout rate following the combustion reaction such as the heterogeneous surface reaction is faster than the diffusion rate of oxygen, so the oxygen concentration becomes thinned in the interface where the combustion reaction takes place, causing oxygen deficiency. The alcohol, which is a component of the fuel additive for heavy oil according to the present invention, serves as an oxygen carrier during the combustion of heavy oil used as a fuel oil. The alcohol is preferably an alcohol with a low boiling temperature. The alcohol with low boiling temperature increases the surface area for the combustion reaction through evaporation in the oil droplets formed by burner spray and thus contributes to the complete combustion. The alcohol with low boiling temperature is preferably an alcohol having 1 to 5 carbon atoms, more preferably isopropyl alcohol or isobutyl alcohol.

In the fuel additive for heavy oil according to the present invention, the content of the alcohol is preferably 15 to 25 wt. %, more preferably 17 to 23 wt. %, most preferably 18 to 22 wt. %, with respect to the total weight of the composition, in consideration of the effect of minimizing the production of dust and securing the compatibility with other components.

Hydrotreated Light Distillate

The hydrotreated light distillate, which is one of the components of the fuel additive for heavy oil according to the present invention, serves as a dispersant for preventing the formation of sludge.

The hydrotreated light distillate also has a role in lowering the flash point of the heavy oil and reducing the kinematic viscosity of the heavy oil. The term "hydrotreated" implies the process of adding hydrogen to oil or the like. Further the light distillate means a light hydrocarbon first distilled during the distillation of crude oil. Specific examples of the hydrotreated light distillate may include, but are not limited to, CAS 64742-47-8 or CAS 68921-07-3 products.

In the fuel additive for heavy oil according to the present invention, the content of the hydrotreated light distillate is preferably 10 to 20 wt. %, more preferably 11 to 19 wt. %, most preferably 13 to 17 wt. %, with respect to the total weight of the composition, in consideration of the effects of reducing the flash point and the kinematic viscosity of the heavy oil, minimizing the production of dust and securing the compatibility with other components.

Kerosene

The kerosene, which is one of the components of the fuel additive for heavy oil according to the present invention, lowers the flash point of the heavy oil, reduces the kinematic viscosity of the heavy oil, and dilutes the fuel additive.

In the fuel additive for heavy oil according to the present invention, the content of the kerosene is preferably 5 to 15 wt. %, more preferably 7 to 13 wt. %, most preferably 8 to 12 wt. %, with respect to the total weight of the composition, in consideration of the effects of reducing the flash point and the kinematic viscosity of the heavy oil, minimizing the production of dust and securing the compatibility with other components.

Mineral Oil

Mineral oil is a liquid byproduct of the distillation of petroleum to produce petroleum-based products from crude oil. A mineral oil is often referred as liquid paraffin. Examples of the mineral oil may include paraffinic oil based on n-alkanes, naphthenic oil based on cycloalkanes, and aromatic oil based on aromatic hydrocarbons. In the present invention, the mineral oil includes such liquid paraffins and their modified forms. The mineral oil maintains the shape of the sludge re-dispersed into particles and also serves as a lubricating agent for internal-combustion engines. In the fuel additive for heavy oil according to the present invention, the mineral oil is preferably paraffinic oil, more preferably hydrotreated or dewaxed, modified paraffinic oil. Specific examples of the hydrotreated or dewaxed, modified paraffinic oil may include, but are not limited to, at least one selected from the group consisting of hydrotreated heavy paraffinic distillate (CAS 64742-54-7), hydrotreated light paraffinic distillate (CAS 64742-55-8), solvent-dewaxed heavy paraffinic distillate (CAS 64742-65-0), solvent-dewaxed light paraffinic distillate (CAS 64742-56-9), hydrotreated and dewaxed heavy paraffinic distillate (CAS 91995-39-0), and hydrotreated and dewaxed light paraffinic distillate (CAS 91995-40-3).

In the fuel additive for heavy oil according to the present invention, the content of the mineral oil is preferably 5 to 15 wt. %, more preferably 7 to 13 wt. %, most preferably 8 to 12 wt. %, with respect to the total weight of the composition, in consideration of the effects of reducing the flash point and the kinematic viscosity of the heavy oil, minimizing the production of dust and residual carbon fraction and securing the compatibility with other components.

The nonionic surfactant, which is one of the components of the fuel additive for heavy oil according to the present invention, serves as a dispersant to prevent the formation of sludge and re-disperse the produced sludge into particles. Particularly, the nonionic surfactant shows a repulsive reaction by steric hindrance to form a stable dispersed system. Due to its nonionic property, the nonionic surfactant when used in combination with ionic substances such as the oil-soluble metallic compound greatly enhances the dispersion performance.

The nonionic surfactant used in the present invention is not specifically limited in its type and may include ester-based nonionic surfactants, ether-based nonionic surfactants, fatty acid amide-based nonionic surfactants, aliphatic amine derivatives, and so forth. Specific examples of the ester-based nonionic surfactants may include sorbitan fatty acid esters, pentaerythritol fatty acid esters, propylene glycol fatty acid monoesters, glycerin fatty acid monoesters, polyethylene glycol sorbitan fatty acid esters, polyethylene glycol sorbitol fatty acid esters, polyethylene glycol fatty acid esters, etc. Specific examples of the ether-based nonionic surfactants may include polyoxyethylene alkyl ethers, polyoxyethylene alkylphenyl ethers, alkylpolyglycosides, etc. Specific examples of the fatty acid amide-based nonionic surfactants may include fatty acid dialkanol amides, fatty acid monoalkanol amides, polyoxyethylene fatty acid amides, etc. Specific examples of the aliphatic amine derivatives as nonionic surfactants may include polyoxyethylene alkyl amines, etc. The nonionic surfactant used in the present invention is preferably polyethylene glycol fatty acid esters in consideration of the effects of reducing the flash point and the kinematic viscosity of the heavy oil, minimizing the production of dust and residual carbon fraction and securing the compatibility with other components. Specific examples of the polyethylene glycol fatty acid esters may include polyethylene glycol dilaurate, polyethylene glycol monooleate, polyethylene glycol dioleate, polyethylene glycol monoricinoleate, polyethylene glycol monostearate, etc. Among these, most preferred is polyethylene glycol monooleate.

The other aspect of the present invention is directed to a fuel oil based on the heavy oil. The fuel oil based on the heavy oil according to the present invention comprises a heavy oil and the aforementioned fuel additive for heavy oil. The heavy oil is not specifically limited to its type and may include fuel oil A, fuel oil B, fuel oil C (or bunker fuel oil C), or a composite fuel oil of these. The content of the fuel additive for heavy oil in the fuel oil is not specifically limited, but it is preferably in the range of 0.001 to 1 part by weight per 100 parts by weight of the heavy oil in consideration of the effects of reducing the flash point and the kinematic viscosity of the fuel addictive, minimizing the production of dust and residual carbon fraction and economical efficiency of the fuel oil.

Hereinafter, a further detailed description will be given as to the present invention with reference to the examples, which are for more definite illustrations only and not intended to limit the scope of the present invention.

1.

Preparation Example 1

A fuel additive is prepared by mixing, under agitation, parts by weight of calcium dodecyl benzene sulfonate, 25 parts by weight of isobutyl alcohol, 18.75 parts by weight of hydrotreated light distillate (CAS 64742-47-8), 12.5 parts by weight of kerosene, 12.5 parts by weight of hydrotreated heavy paraffinic distillate (CAS 64742-54-7), and 6.24 parts by weight of polyethylene glycol monooleate (CAS 9004-96-0).

Preparation Example 2

A fuel additive is prepared by mixing, under agitation, parts by weight of calcium dodecyl benzene sulfonate, 20 parts by weight of isobutyl alcohol, 15 parts by weight of hydrotreated light distillate (CAS 64742-47-8), 10 parts by weight of kerosene, 10 parts by weight of hydrotreated heavy paraffinic distillate (CAS 64742-54-7), and 5 parts by weight of polyethylene glycol monooleate (CAS 9004-96-0).

Preparation Example 3

A fuel additive is prepared by mixing, under agitation, parts by weight of calcium dodecyl benzene sulfonate, 15 parts by weight of isobutyl alcohol, 1.25 parts by weight of hydrotreated light distillate (CAS 64742-47-8), 7.5 parts by weight of kerosene, 7.5 parts by weight of hydrotreated heavy paraffinic distillate (CAS 64742-54-7), and 3.75 parts by weight of polyethylene glycol monooleate (CAS 9004-96-0).

Preparation Example 4

A fuel additive is prepared by mixing, under agitation, parts by weight of calcium acetylacetonate, 20 parts by weight of isobutyl alcohol, 15 parts by weight of hydrotreated light distillate (CAS 64742-47-8), 10 parts by weight of kerosene, 10 parts by weight of hydrotreated heavy paraffinic distillate (CAS 64742-54-7), and 5 parts by weight of polyethylene glycol monooleate (CAS 9004-96-0).

Preparation Example 5

A fuel additive is prepared by mixing, under agitation, 40 parts by weight of calcium naphthenate, 20 parts by weight of isobutyl alcohol, 15 parts by weight of hydrotreated light distillate (CAS 64742-47-8), 10 parts by weight of kerosene, 10 parts by weight of hydrotreated heavy paraffinic distillate (CAS 64742-54-7), and 5 parts by weight of polyethylene glycol monooleate (CAS 9004-96-0).

Preparation Example 6

The procedures are performed in the same manner as described in the preparation example 5 to prepare a fuel additive, excepting that barium naphthenate is used in place of calcium naphthenate.

Preparation Example 7

The procedures are performed in the same manner as described in the preparation example 5 to prepare a fuel additive, excepting that manganese naphthenate is used in place of calcium naphthenate.

Preparation Example 8

The procedures are performed in the same manner as described in the preparation example 5 to prepare a fuel additive, excepting that iron naphthenate is used in place of calcium naphthenate.

Comparative Preparation Example 1

A fuel additive is prepared by mixing, under agitation, 50 parts by weight of calcium naphthenate, 35 parts by weight of isobutyl alcohol, and 15 parts by weight of kerosene.

Comparative Preparation Example 2

The procedures are performed in the same manner as described in the preparation example 5 to prepare a fuel additive, excepting that magnesium naphthenate is used in place of calcium naphthenate.

2.

(1) Preparation of Fuel Oil Based on Bunker Fuel Oil C

Example 1

100 parts by weight of bunker fuel oil C and 0.1 part by weight of the fuel additive obtained in the preparation example 1 are mixed together and stirred to prepare a fuel oil based on heavy oil.

Example 2

100 parts by weight of bunker fuel oil C and 0.1 part by weight of the fuel additive obtained in the preparation example 2 are mixed together and stirred to prepare a fuel oil based on heavy oil.

Example 3

100 parts by weight of bunker fuel oil C and 0.1 part by weight of the fuel additive obtained in the preparation example 3 are mixed together and stirred to prepare a fuel oil based on heavy oil.

Example 4

100 parts by weight of bunker fuel oil C and 0.1 part by weight of the fuel additive obtained in the preparation example 4 are mixed together and stirred to prepare a fuel oil based on heavy oil.

Example 5

100 parts by weight of bunker fuel oil C and 0.1 part by weight of the fuel additive obtained in the preparation example 5 are mixed together and stirred to prepare a fuel oil based on heavy oil.

Example 6

100 parts by weight of bunker fuel oil C and 0.1 part by weight of the fuel additive obtained in the preparation example 6 are mixed together and stirred to prepare a fuel oil based on heavy oil.

Example 7

100 parts by weight of bunker fuel oil C and 0.1 part by weight of the fuel additive obtained in the preparation example 7 are mixed together and stirred to prepare a fuel oil based on heavy oil.

Example 8

100 parts by weight of bunker fuel oil C and 0.1 part by weight of the fuel additive obtained in the preparation example 8 are mixed together and stirred to prepare a fuel oil based on heavy oil.

Example 9

100 parts by weight of bunker fuel oil C and 0.025 part by weight of the fuel additive obtained in the preparation example 2 are mixed together and stirred to prepare a fuel oil based on heavy oil.

Comparative Example 1

100 parts by weight of bunker fuel oil C and 0.1 part by weight of the fuel additive obtained in the comparative preparation example 1 are mixed together and stirred to prepare a fuel oil based on heavy oil.

Comparative Example 2

100 parts by weight of bunker fuel oil C and 0.1 part by weight of the fuel additive obtained in the comparative preparation example 2 are mixed together and stirred to prepare a fuel oil based on heavy oil.

Comparative Example 3

100 parts by weight of bunker fuel oil C and 0.025 part by weight of the fuel additive obtained in the comparative preparation example 1 are mixed together and stirred to prepare a fuel oil based on heavy oil.

(2) Preparation of Fuel Oil Based On Fuel Oil A

Example 10

100 parts by weight of heavy oil A and 0.025 part by weight of the fuel additive obtained in the preparation example 2 are mixed together and stirred to prepare a fuel oil based on heavy oil.

Comparative Example 4

100 parts by weight of heavy oil A and 0.025 part by weight of the fuel additive obtained in the comparative preparation example 1 are mixed together and stirred to prepare a fuel oil based on heavy oil.

3. C

Each of the fuel oils based on bunker fuel oil C as prepared in the examples 1 to 8 and the comparative examples 1 and 2 are added to a boiler with a scale capable of processing 1.5 ton of fuel oil per hour and combusted to measure the concentration of exhaust dust. As a control, pure bunker fuel oil C without containing a fuel additive is used to fuel a boiler.

Table 1 shows the results of an experiment on the reduction of dust for bunker fuel oil C according to the addition of a fuel additive. In Table 1, the dust concentration means the relative dust concentration while the dust concentration during the combustion of pure bunker fuel oil C is 100.

TABLE 1

| Div. | | Dust Concentration |
|---|---|---|
| Control (Bunker fuel oil C) | | 100 |
| Example | 1 | 14.2 |
| | 2 | 11.1 |
| | 3 | 13.5 |
| | 4 | 18.3 |
| | 5 | 15.2 |
| | 6 | 20.7 |
| | 7 | 24.7 |
| | 8 | 23.7 |

TABLE 1-continued

| Div. | | Dust Concentration |
|---|---|---|
| Comparative Example | 1 | 29.6 |
| | 2 | 72.5 |

4. C

The fuel oils based on bunker fuel oil C as prepared in the example 9 and the comparative example 3 are measured in regards to kinematic viscosity, residual carbon fraction, sulfur fraction, caloric value, and specific gravity to evaluate the change of properties and the combustion characteristics of the bunker fuel oil C according to the addition of a fuel additive. Also, pure bunker fuel oil C without containing a fuel additive is used as a control. The measurement results are presented in Table 2.

TABLE 2

| Test Item | Control (Bunker fuel oil C) | Example 9 | Comparative Example 3 | Test Method |
|---|---|---|---|---|
| Kinematic viscosity (50° C., $mm^2/s$) | 178.9 | 146.6 | 162.6 | KS M 2014: 1999 |
| Residual carbon fraction (wt. %) | 5.95 | 5.49 | 5.89 | KS M 2017: 1986 |
| Sulfur fraction (wt. %) | 0.45 | 0.42 | 0.44 | KS M 2027: 1998 |
| Caloric value (J/g) | 43,490 | 43,990 | 43,520 | KS M 2057: 1997 |
| Specific gravity (15/4° C.) | 0.9429 | 0.9428 | 0.9426 | KS M 2002: 1996 |

As can be seen from the table 2, the fuel additive according to the present invention can remarkably lower the kinematic viscosity of the bunker fuel oil C, reduce the residual carbon fraction and the sulfur fraction, and increase the caloric value of the bunker fuel oil C.

5. A

The fuel oils based on heavy oil A as prepared in the example 10 and the comparative example 4 are measured in regards to flow point, flash point, kinematic viscosity, residual carbon fraction, and caloric value to evaluate the change of properties and the combustion characteristics of the heavy oil A according to the addition of a fuel additive. Also, pure heavy oil A without containing a fuel additive is used as a control. The measurement results are presented in Table 3.

TABLE 3

| Test Item | Control (Heavy oil A) | Example 10 | Comparative Example 4 | Test Method |
|---|---|---|---|---|
| Flow point (° C.) | −12.5 | −12.5 | −12.5 | KS M 2016: 2005 |
| Flash point (PM, ° C.) | 72 | 61 | 68 | KS M 2010: 2004 |
| Kinematic viscosity (50° C., $mm^2/s$) | 9,415 | 8,931 | 9,295 | KS M 2014: 2004 |

TABLE 3-continued

| Test Item | Control (Heavy oil A) | Example 10 | Comparative Example 4 | Test Method |
|---|---|---|---|---|
| Residual carbon fraction (wt. %) | 3.44 | 3.41 | 3.43 | KS M 2017: 2001 |
| Caloric value (J/g) | 44,580 | 44,570 | 44,570 | KS M 2057: 1997 |

As can be seen from the table 3, the fuel additive according to the present invention can remarkably lower the flash point and the kinematic viscosity of the heavy oil A and reduce the residual carbon fraction.

The present invention has been described with reference to the particular illustrative embodiments, which are not intended to limit the scope of the present invention but susceptible to many changes and modifications without departing from the scope and spirit of the present invention. Further, specific situations and materials can be adopted in the specification of the present invention by changes and modifications without departing from the substantial scope of the present invention. The scope of the present invention is not limited to the specific embodiments disclosed as the best modes planned to realize the present invention but includes all the embodiments according to the claims of the present invention.

The invention claimed is:

1. A fuel additive for heavy oil comprising:

25 to 55 wt. % of an oil-soluble metallic compound comprising at least one selected from the group consisting of calcium sulfonate, calcium acetylacetonate, calcium naphthenate, and calcium oxalate;

15 to 25 wt. % of an alcohol;

10 to 20 wt. % of a hydrotreated light distillate;

5 to 15 wt. % of kerosene;

5 to 15 wt. % of a mineral oil; and 2 to 8 wt. % of a nonionic surfactant of a polyethylene glycol fatty acid ester, wherein the mineral oil comprises at least one selected from the group consisting of hydrotreated heavy paraffinic distillate or hydrotreated light paraffinic distillate, solvent-dewaxed heavy paraffinic distillate, solvent-dewaxed light paraffinic distillate, hydrotreated and dewaxed heavy paraffinic distillate, and hydrotreated and dewaxed light paraffinic distillate.

2. The fuel additive for heavy oil as claimed in claim 1, wherein the calcium sulfonate is calcium alkylbenzenesulfonate, wherein the alkyl of the calcium alkylbenzenesulfonate has 8 to 20 carbon atoms.

3. The fuel additive for heavy oil as claimed in claim 2, wherein the calcium alkylbenzenesulfonate is calcium dodecyl benzene sulfonate.

4. The fuel additive for heavy oil as claimed in claim 1, wherein the alcohol has 1 to 5 carbon atoms.

5. The fuel additive for heavy oil as claimed in claim 4, wherein the alcohol is isobutyl alcohol.

6. The fuel additive for heavy oil as claimed in claim 1, wherein the nonionic surfactant is polyethylene glycol monooleate.

7. A fuel oil based on heavy oil comprising a heavy oil and the fuel additive for heavy oil as claimed in claim 1.

8. The fuel oil based on heavy oil as claimed in claim 7, wherein the content of the fuel additive for heavy oil in the fuel oil is 0.001 to 1 part by weight per 100 parts by weight of the heavy oil.

* * * * *